US006627014B1

(12) United States Patent
Blomquist

(10) Patent No.: US 6,627,014 B1
(45) Date of Patent: Sep. 30, 2003

(54) SMOKELESS GAS GENERATING MATERIAL FOR A HYBRID INFLATOR

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/633,593

(22) Filed: Aug. 7, 2000

(51) Int. Cl.[7] ..... C06B 31/00; C06B 31/02

(52) U.S. Cl. ..... 149/45; 149/61; 149/75; 149/92; 149/19.9

(58) Field of Search ..... 149/45, 61, 75, 149/92, 19.9

(56) References Cited

U.S. PATENT DOCUMENTS 3,779,825 A * 12/1973 Blackwell ..... 149/19
3,982,975 A * 9/1976 Elrick et al. ..... 149/19.9
4,427,468 A 1/1984 Duchesne et al.
5,125,684 A 6/1992 Cartwright
6,009,810 A 1/2000 Walsh
6,059,906 A * 5/2000 Fleming et al. ..... 149/19.92
6,238,499 B1 * 5/2001 Jones et al. ..... 149/19.4
6,319,341 B1 * 11/2001 Blomquist ..... 149/19.92
6,368,431 B1 * 4/2002 Mangum et al. ..... 149/19.7

* cited by examiner

*Primary Examiner*—Michael J. Carone
*Assistant Examiner*—Aileen B. Felton
(74) *Attorney, Agent, or Firm*—Tarolli, Sunheim, Covell & Tummino L.L.P.

(57) ABSTRACT

An apparatus (10) for inflating an inflatable vehicle occupant protection device comprises a container (12) for storing a supply of gas. A gas (26) is stored in the container (12) at an elevated pressure. The gas comprises an oxygen rich oxidizer gas. A gas generating material (84) is stored in the container (12) and is exposed to the oxidizer gas at the elevated pressure. The gas generating material (84) comprises a cellulose based binder blended with an anti-oxidant material. An igniter (52) is provided for igniting the gas generating material (84).

4 Claims, 1 Drawing Sheet

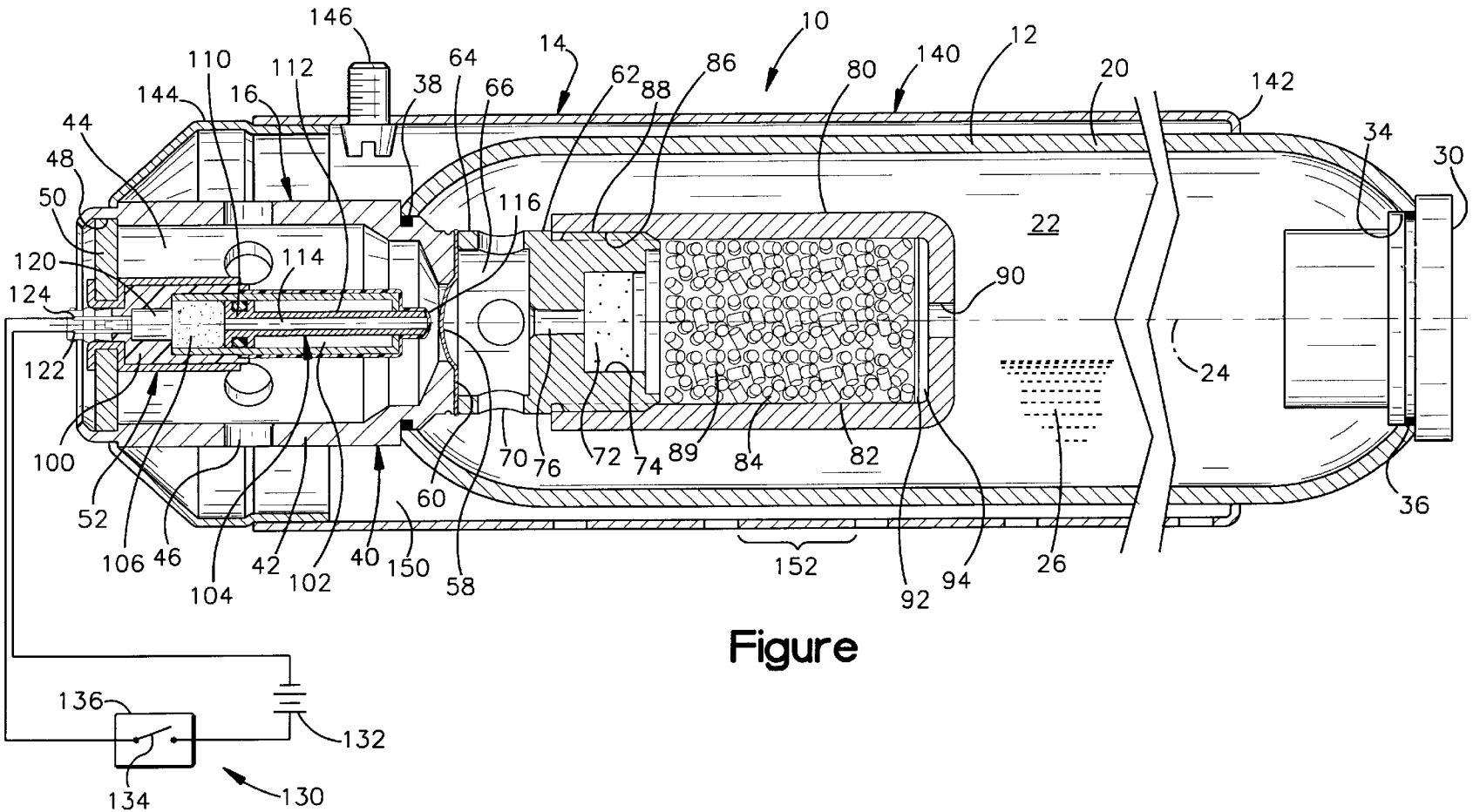
Figure

SMOKELESS GAS GENERATING MATERIAL FOR A HYBRID INFLATOR

FIELD OF THE INVENTION

The present invention relates to a hybrid inflator for inflating an inflatable vehicle occupant protection device, and particularly relates to a gas generating material for inflating an inflatable vehicle occupant protection device.

BACKGROUND OF THE INVENTION

A hybrid inflator for inflating a vehicle occupant protection device includes a quantity of a stored gas and a gas generating material. The stored gas typically comprises an inert gas and an oxidizer gas. The oxidizer gas helps to support the combustion of the gas generating material. An igniter is actuatable to ignite the gas generating material. As the gas generating material burns, it generates heat and a volume of combustion gas. The heat and combustion gas increase the pressure of the inert gas. The heated inert gas and combustion gas form the inflation fluid. The inflation fluid is directed into the air bag to inflate the air bag. When the air bag is inflated, it expands into the vehicle occupant compartment and helps to protect the vehicle occupant.

U.S. Pat. No. 5,125,684 discloses a gas generating material for use in a vehicle occupant restraint system. The gas generating material comprises cyclotetramethylenetetranitramine (HMX) or cyclotrimethylenetrinitramine (RDX), an oxidizer salt, and a cellulose based binder. The advantage of using the cellulose based binder in the gas generating material formulation is that the cellulose based binder produces a low-level of carbon monoxide upon combustion compared to conventional polymeric binders.

Cellulose based binders are generally resistant to oxidation and degradation at atmospheric pressure. It has been discovered, however, that cellulose based binders oxidize and degrade, over time, when stored in a high pressure oxygen rich atmosphere (e.g., an atmosphere with a pressure greater than 1,000 psi and a concentration of oxygen greater than 10% by weight). Free radicals of oxygen in a high pressure oxygen rich atmosphere oxidize the chemical double bonds of the cellulose based binder. The oxidized bonds cleave and cause the polymer chain of the cellulose based binder to fragment.

SUMMARY OF THE INVENTION

The present invention is an apparatus for inflating an inflatable vehicle occupant protection device. The apparatus comprises a container for storing a supply of gas. A gas is stored in the container at an elevated pressure. The gas comprises an oxygen rich oxidizer gas. A gas generating material is stored in the container and is exposed to the oxidizer gas at the elevated pressure. The gas generating material comprises a cellulose based binder blended with an anti-oxidant material. An igniter is provided for igniting the gas generating material.

BRIEF DESCRIPTION OF THE DRAWINGS

The foregoing and other features of the invention will become apparent to one skilled in the art upon consideration of the following description of the invention and the accompanying drawing in which the figure is a sectional view of an inflator which is constructed in accordance with the present invention.

DESCRIPTION OF THE PREFERRED EMBODIMENT

An inflator 10 provides inflation fluid for inflating a vehicle occupant protection device, such as an air bag (not shown). The inflator 10 includes a generally cylindrical container 12, a generally cylindrical diffuser 14, and a manifold assembly 16.

The container 12 includes a generally cylindrical one-piece steel side wall 20 that defines a chamber 22. The side wall 20 has a longitudinal central axis 24. The chamber 22 is filled with a gas 26 under pressure, which is introduced into the chamber 22 through end cap 30. The end cap 30 extends through an opening 34 at the right end (as shown in the Figure) of the container and is connected to the container 12 by an annular weld 36. The end cap 30 includes a passage (not shown) through which the gas 26 is conducted into the chamber 22. Once the chamber 22 has been filled with gas 26 at a desired pressure, the passage is closed by suitable means such as a steel ball (not shown) welded in place.

The gas 26 is stored in the container 12 at a pressure of about 1000 psi to about 5,000 psi. The gas 26 is preferably stored in the container 12 at a pressure of about 2,000 psi to about 3,500 psi. The end cap 30 may also include a conventional pressure switch (not shown) from which the gas pressure in the chamber 22 can be monitored if the gas pressure in the chamber 22 drops below a set pressure.

The gas 26 stored in the container 12 comprises a mixture of at least one inert gas and at least one oxygen rich oxidizer gas. Preferred inert gases are helium (He) and argon (Ar). Preferably, the inert gases comprise a mixture of argon and helium, with helium being present in an amount sufficient to act as a leak detector. Preferred oxygen rich oxidizer gases include oxygen and nitrous oxide. The oxygen rich oxidizer gas is preferably the only gas other than the inert gases present in the gas 26 stored in the container 12.

Preferably, the gas 26 stored in the container 12 comprises, on a weight basis, about 10% to about 25% oxygen, and about 1% to about 5% helium, with the balance being argon. A preferred composition of the stored gas 26 is 75% argon, 20% oxygen, and 5% helium.

The manifold assembly 16 is secured to the container 12 by a friction weld 38 at the left end (as viewed in the Figure) of the container 12. The manifold assembly 16 is disposed in coaxial relationship with the end cap 30 and the side wall 20 of the container 12. The manifold assembly 16 projects both axially into and axially away from the container 12. The manifold assembly 16 includes a generally cylindrical metal manifold plug 40 that is disposed partially outside of the container 12. The manifold plug 40 includes a generally cylindrical side wall 42, which defines a generally cylindrical interior cavity 44. A plurality of circular outlet openings 46 are disposed in a circular array in the manifold side wall 42. The outer end 48 of the manifold plug 40 is closed by a circular end wall 50. An actuator assembly 52 is disposed in the manifold end wall 50 and extends into the manifold cavity 44.

A burst disk 58 extends across a circular opening at the interior end 60 of the manifold plug 40. The burst disk 58 blocks gas flow from the chamber 22 of the container 12 into the manifold cavity 44 until the burst disk 58 is ruptured by the actuator assembly 52.

The manifold assembly 16 also includes a cylindrical holder 62, which is coaxial with the manifold plug 40 and is disposed within the container 12. The holder 62 includes a generally cylindrical side wall 64, which defines a generally cylindrical cavity 66. The holder 62 is welded to the periphery of the burst disk 58, which is in turn welded to the interior end 60 of the manifold plug 40. The manifold plug 40, holder 62, and the burst disk 58 are thus all welded together to form the unitary manifold assembly 16.

A plurality of circular inlet openings 70 are arranged in a circular array in the holder side wall 64. The openings 70 provide fluid communication between the chamber 22 of the container 12 and the holder cavity 66.

A booster charge 72 is disposed in a cylindrical chamber 74 formed in the end of the manifold holder 62 removed from the burst disk 58. The booster chamber 74 is connected in fluid communication with the holder cavity 66 through a generally cylindrical opening 76. The booster chamber 74 and opening 76 are coaxial with the burst disk 58 and the actuator assembly 52.

The booster charge 72 is readily ignited to ignite a gas generating material 84. The booster charge 72 is securely held in the chamber 74 and is enclosed by a thin covering of polymeric material (not shown), which is destroyed upon burning of the booster charge 72. The ignitable material forming the booster charge 72 is preferably boron potassium nitrate ($BKNO_3$), but could have a different composition well known to those skilled in the art, if desired.

A generally cylindrical metal housing 80, having a chamber 82, encloses the gas generating material 84, which is disposed within the chamber 82. One end of the housing 80 is disposed adjacent the manifold holder 62 and has a threaded, interior circumferential surface 86. The threaded surface 86 of the housing 80 engages a threaded, exterior circumferential surface 88 on the manifold holder 62 so that the housing 80 is mounted on the manifold holder 62. The housing 80 is coaxial with the holder 62 and the booster charge 72 in the booster chamber 74.

In a preferred embodiment, the gas generating material 84 comprises a plurality of randomly oriented cylindrical grains 89 disposed within the chamber 82. The grains 89 may be similar or identical in configuration.

Although the gas generating material 84 has been illustrated as a plurality of randomly oriented cylindrical grains 89, it is contemplated that the gas generating material 84 could be formed with a different configuration if desired. For instance, the gas generating material 84 may have a multi-lobe cross-sectional configuration or may comprise a plurality of stacked cylinders.

At its end opposite from the manifold assembly 16, the housing 80 is substantially closed except for a circular orifice 90. The housing orifice 90 is disposed in a coaxial relationship with the housing chamber 82. The inside of the housing chamber 82 is in fluid communication with the chamber 22 in the container 12 through the housing orifice 90. The orifice 90 is continuously open so that the gas 26 stored in the chamber 22 can flow into the housing chamber 82 around the gas generating material 84.

Disposed between the gas generating material 84 and the orifice 90 is a flat baffle plate 92 and a flat circular orifice plate 94 through which an orifice (not shown) extends. These plates 92 and 94 help retain the gas generating material 84 within the chamber 82. During burning of the gas generating material 84, combustion products from the burning gas generating material impinge against the baffle plate 92. After passing the baffle plate 92, the combustion products enter into the chamber 22 through the orifice plate 94 and the housing orifice 90.

The actuator assembly 52 includes a cylindrical housing 100 having a cylindrical chamber 102 in which a piston 104 and a pyrotechnic charge 106 of ignitable material are disposed in coaxial relationship. The actuator housing 100 is secured to the manifold end wall 50 and is disposed in a coaxial relationship with the burst disk 58, the booster charge 72, and the gas generating material 84. The diameter and length of the actuator assembly 52 are sufficiently smaller than the diameter and length of the manifold cavity 44 so that the stored gas 26 can flow from the chamber 22 and the holder cavity 66 through the manifold cavity 44 to the manifold outlet openings 46 when the burst disk 58 is ruptured.

The piston 104 is formed from a single piece of metal and has a cylindrical head end portion 110. A smaller diameter cylindrical piston rod 112 extends axially away from the head end portion 110. A cylindrical central passage 114 in the piston rod 112 is coaxial with and extends through the head end portion 110 and piston rod 112 of the piston 104. The cylindrical piston rod 112 has a tip 116 at its outer end portion.

The pyrotechnic charge 106 is disposed in the actuator chamber 102 in a position that is adjacent to the head end portion 110 of the piston 104. A squib 120 is located adjacent the pyrotechnic charge 106. Two electrically conductive pins 122 and 124 are connected with the squib 120. The pins 122 and 124 extend through an opening in the manifold assembly 16. The pins 122 and 124 provide a path for electrical current to actuate the squib 120.

The squib 120 and pins 122 and 124 are included in an electrical circuit 130. The electrical circuit 130 further includes a power source 132, which preferably is the vehicle battery and/or a capacitor, and a normally open switch 134. The switch 134 is part of a sensor 136 that senses a condition indicating the occurrence of a vehicle collision. The collision indicating condition may comprise, for example, sudden vehicle deceleration caused by a collision. If the collision indicating condition is above a predetermined threshold, it indicates the occurrence of a collision for which inflation of the inflatable vehicle occupant protection device is desired to help protect an occupant of the vehicle.

The diffuser 14 is larger in diameter than the container 12 and is mounted on the outside of the container 12 to encircle both the container 12 and the manifold assembly 16. The diffuser 14 also extends substantially the entire length of the manifold assembly 16 and a significant portion of the length of the container 12.

The diffuser 14 includes a cylindrical diffuser tube 140 having an annular, radially inwardly directed in-turned lip 142 at one end. The in-turned lip 142 tightly engages a cylindrical outer side surface of the container wall 20. An end cap 144 is welded to the end of the diffuser tube 140 opposite from the in-turned lip 142. The end cap 144 is connected to an outer end portion of the manifold assembly 16. A mounting stud 146 is connected with the diffuser tube 140 adjacent the end cap 144. The mounting stud 146 is used to mount the inflator assembly to a reaction can (not shown), which can be mounted at a desired location in the vehicle. The diffuser 14 defines a diffuser chamber 150 around the manifold assembly 16 and the container 12. The diffuser 14 has openings 152, which provide fluid communication from the diffuser chamber 150 to the inflatable vehicle occupant protection device.

Upon the occurrence of sudden vehicle deceleration indicative of a collision for which inflation of the vehicle occupant protection device is desired, the crash sensor 136 closes the normally open switch 134. Closure of the normally open switch 134 causes electric current to be transmitted from the power source 132 to the squib 120. This in turn causes the squib 120 to ignite the pyrotechnic charge 106. Burning of the pyrotechnic charge 106 forces the piston rod 104 to move axially and penetrate the burst disk 58. Burning gases from the pyrotechnic charge 106 flow through the passage 114 and ignite the booster charge 72. The burning booster charge, in turn, ignites the gas generating material 84 to produce initial combustion products such as carbon monoxide, carbon dioxide, water, hydrogen cyanide and nitrogen, and a first quantity of heat.

As the gas generating material 84 burns, the hot combustion products flow through the orifice 90 to mix with and heat the stored gas 26 in the chamber 22 of the container 12. Any partially combusted initial combustion products (i.e., carbon monoxide, hydrogen cyanide, etc.) of the gas generating material 84 further combust in the presence of the oxygen rich oxidizer gas to form an essentially non-toxic subsequent combustion product and second quantity of heat. The first quantity of heat and the second quantity of heat increase the temperature and hence the pressure of the stored gases 26 in the chamber 22 including the inert gases.

The stored gas 26, and the combustion products provide an inflation fluid that flows from the chamber 22 through the manifold inlet openings 70 into the manifold assembly 16. The inflation fluid flows through the manifold assembly 16 into the manifold cavity 66, and then through the manifold outlet openings 46 into the diffuser chamber 150. The inflation fluid then flows from the diffuser 14 through openings 152 into the vehicle occupant protection device.

In accordance with the present invention, the gas generating material 84 comprises a fuel. The fuel of the gas generating material can be any non-azide nitrogen containing fuel commonly used in a gas generating material for inflating a vehicle occupant protection device. The non-azide nitrogen containing fuel is a material capable of undergoing rapid and substantially complete oxidation upon combustion of the gas generating material. In a preferred embodiment of the present invention, the non-azide nitrogen containing fuel is a nitramine. Preferred nitramines are selected from the group consisting of cyclotrimethylenetrinitramine (RDX), cyclotetramethylenetetranitramine (HMX), and mixtures of cyclotetramethylenetetranitramine and cyclotrimethylenetrinitramine.

The non-azide nitrogen containing fuel can also be other non-azide nitrogen containing organic fuels typically used in a gas generating material for inflating a vehicle occupant protection device including: cyanamides such as dicyanamide and salts of cyanamides; tetrazoles such as 5-aminotetrazole and derivatives and salts of tetrazoles; carbonamides such as azo-bis-dicarbonamide and salts of carbonamide; triazoles such as 3-nitro-1,2,4-triazole-5-one (NTO) and salts of triazoles; guanidine and other derivatives of guanidine such as nitroguanidine (NQ) and other salts of guanidine and guanidine derivatives; tetramethyl ammonium nitrate; urea and salts of urea; and mixtures thereof.

The fuel is incorporated in the gas generating material in the form of particles. The average particle size of the fuel is from about 1 $\mu$m to about 100 $\mu$m. Preferably, the average particle size of the fuel is from about 1 $\mu$m to about 20 $\mu$m.

The amount of fuel in the gas generating material 84 is that amount necessary to achieve sustained combustion of the gas generating material. The amount can vary depending upon the particular fuel involved and other reactants. A preferred amount of fuel is in the range of about 20% to about 80% by weight of the gas generating material. More preferably, the amount of fuel in the gas generating material is from about 40% to about 70% by weight of the gas generating material.

The gas generating material 84 further includes an oxidizer. The oxidizer can be any oxidizer commonly used in a gas generating material for inflating a vehicle occupant protection device. A preferred oxidizer is an inorganic salt oxidizer. Examples of inorganic salt oxidizers that can be used in a gas generating material for inflating a vehicle occupant protection device are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, alkali metal chlorates such as sodium chlorate, lithium chlorate and potassium chlorate, alkaline earth metal chlorates such as magnesium chlorate and calcium chlorate, ammonium perchlorate, ammonium nitrate, and mixtures thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces upon combustion hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The oxidizer is incorporated in the gas generating material in the form of particles. The average particle size of the oxidizer is from about 1 $\mu$m to about 100 $\mu$m. Preferably, the average particle size of the oxidizer is from about 1 $\mu$m to about 20 $\mu$m.

The amount of oxidizer in the gas generating material 84 is that amount necessary to achieve sustained combustion of the gas generating material. The amount of inorganic salt oxidizer necessary to achieve sustained combustion of the gas generating composition is from preferably about 20% to about 60% by weight of the gas generating material.

The gas generating material 84 also includes a binder that is mixed with the fuel and oxidizer to provide an intimate mixture of the oxidizer and the fuel. The binder of the present invention is a cellulose based binder. By cellulose based, it is meant that the binder is a polymer that is a chemical derivative of cellulose. Preferred cellulose based binders are esters of cellulose such as cellulose acetate, cellulose acetate propionate, cellulose acetate butyrate, cellulose propionate, cellulose propionate-butyrate, and combinations thereof. Cellulose esters are preferred because these cellulose based binders when combined with solvents are readily extruded and molded. Upon removal of the solvent, the binders form highly resilient solids that are neither brittle at a temperature of about −40° C. nor capable of losing their shape or configuration at a temperature of about 125° C. Examples of other cellulose based binders that can be used in the gas generating material of the present invention are ethers of cellulose such as ethyl cellulose and triethylacetylcellulose and nitrates of cellulose such as nitrocellulose.

A preferred amount of binder is from about 1% to about 20% by weight of the gas generating material 84. More preferably, the amount of binder is from about 2.5% to about 15% by weight of the gas generating material.

In accordance with the present invention, the gas generating material 84 further includes an antioxidant. The antioxidant inhibits oxidation of the cellulose based binder when the gas generating material is stored in the high pressure oxygen rich gas in the chamber 22. The antioxidant inhibits oxidation of the cellulose based binder by preferentially reacting with free radicals of oxygen in the high pressure oxygen rich gas in the chamber 22. The rate at which the antioxidant reacts with free radicals of oxygen is several orders of magnitude greater than the rate at which the cellulose based binder reacts with the free radicals of oxygen in the hybrid inflator. Moreover, the antioxidant reacts with and terminates free radical chain reactions in any cellulose based binder that is oxidized and therefore could degrade.

A preferred antioxidant of the present invention is 2,2-methylene bis(4-methyl)6-t-butylphenol. 2,2-methylene bis (4-methyl)6-t-butylphenol is commercially available from Cyanamid Corporation under the tradename AO2246. 2,2-methylene bis(4-methyl)6-t-butylphenol is preferred as the antioxidant because 2,2-methylene bis(4-methyl)6-t-butylphenol is readily dissolved in solvents utilized for processing the gas generating material 84.

Examples of other antioxidants that can be used in the gas generating material 84 of the present invention are substituted phenolic compounds such as phenylbetanaphthylamine, which is commercially available from Uniroyal Co. under the tradename PBNA, polymerized trimethyl dihydroquinoline, which is commercially available from Uniroyal Co. under the trade name NAUGARDQ, diphenylamine-diisobutylene reaction product, which is commercially available from Uniroyal Co. under the tradename OCTAMINE, N-phenyl-N'-(1,3-dimethylbutyl)-p-phenylene diamine, which is commercially available from Uniroyal Co. under the trade name FLEXZONE 7L, N-phenyl-N'-cyclohexyl-phenylene diamine, which is commercially available from Uniroyal Co. under the trade name FLEXZONE 6H, N-phenyl-N'-cyclohexyl-p-phenylene diamine, which is commercially available from Universal Oil Products under the trade name UOP-36, and di-tert-butylhydroquinone, which is commercially available from Eastman Chemicals Co. under the trade name DTBHQ. The antioxidant of the present invention may also include mixtures of these antioxidants.

The amount of antioxidant is that amount effective to retard oxidation of the cellulose based binder by the high pressure oxygen rich atmosphere in the hybrid inflator. A preferred amount is from about 0.1% to about 1% by weight of the gas generating material. At an amount less than 1% by weight of the gas generating material, the antioxidant does not impair ignition of the gas generating material 84. A more preferred amount is about 0.5% by weight of the gas generating material.

The present invention may also comprise other ingredients commonly added to a gas generating material 84 for providing inflation gas for inflating an inflatable vehicle occupant protection device, such as plasticizers, burn rate modifiers, coolants, and ignition aids, all in relatively small amounts.

Preferably, the components of the gas generating material 84 are present in a weight ratio adjusted to produce upon combustion a gas product that is essentially free of carbon monoxide. By essentially free of carbon monoxide, it is meant that the amount of carbon monoxide in the combustion gas product is less than 4% by volume of the gas product.

The gas generating material is prepared by adding, to a conventional mixer, the cellulose based binder, the antioxidant, and a solvent. The solvent readily dissolves the cellulose based binder and can be removed by evaporation. A preferred solvent is an organic solvent such as ethyl alcohol, ethyl acetate, acetone, or mixtures thereof.

The cellulose based binder, antioxidant, and solvent are mixed until a viscous, yet still fluid solution is formed. The solution of cellulose based binder and antioxidant is poured into an extruder such as a heat jacketed twin screw extruder. The fuel, oxidizer and other ingredients such as plasticizer, burn rate modifier, and coolant, if utilized, are added to and mixed with the solution of cellulose based binder and antioxidant. Alternatively, the cellulose based binder, antioxidant, solvent may be mixed with the fuel, oxidizer, and other ingredients, if utilized, before being mixed in the extruder. The oxidizer and fuel form a viscous slurry, having a dough like consistency, with the solution of cellulose based binder and antioxidant.

The viscous slurry is advanced from the extruder, through a shaping device or die with a predetermined diameter, and cut to desired length. Preferably, the gas generating material has the shape of the plurality of cylindrical grains 89.

The solvent is evaporated from the gas generating material by heating the gas generating material at an elevated temperature (i.e., about 50° C. to about 60° C.) The gas generating material so formed is generally a resilient solid, like a hard rubber, capable of withstanding shock without permanent deformation at 85° C. and not brittle at −40° C.

From the above description of the invention, those skilled in the art will perceive improvements, changes and modifications. Such improvements, changes and modifications within the skill of the art are intended to be covered by the appended claims.

Having described the invention, the following is claimed:

1. A gas generating material comprising:

about 40% to about 70% non-azide nitrogen containing fuel by weight of the gas generating material, about 20% to about 60% oxidizer by weight of the gas generating material, said oxidizer being selected from the group consisting of alkali metal nitrates, alkaline earth metal nitrates, alkali metal perchlorates, alkaline earth metal perchlorates, ammonium perchlorate, and mixtures thereof, about 1% to about 20% cellulose based binder by weight of the gas generating material, and about 0.1% to about 1% antioxidant by weight of the gas generating material.

2. The gas generating material of claim 1 wherein the cellulose based binder is selected from the group consisting of cellulose acetate propionate, cellulose acetate butyrate, cellulose propionate, cellulose propionate-butyrate, and combinations thereof.

3. The gas generating material of claim 1 wherein the antioxidant is selected from the group consisting of 2,2-methylene bis(4-methyl)6-t-butylphenol, phenyl-beta-naphthylamine, polymerized trimethyl dihydroquinoline, diphenylamine-diisobutylene reaction product, N-phenyl-N'-(1,3-dimethyl-butyl)-p-phenylene diamine, N-phenyl-N'-cyclohexyl-phenylene diamine, N-phenyl-N'-cyclohexyl-p-phenylene diamine, di-tert-butylhydroquinone, and combinations thereof.

4. The gas generating material of claim 1 wherein the non-azide organic fuel is selected from the group consisting of cyclotrimethylenetrinitramine (RDX), cyclotetramethylenetetranitramine (HMX), and mixtures of cyclotetramethylenetetranitramine and cyclotrimethylenetrinitramine.

* * * * *